United States Patent [19]

Floyd

[11] Patent Number: 4,890,536

[45] Date of Patent: Jan. 2, 1990

[54] FLOATING FITTING CABLE ATTACHMENT

[75] Inventor: Brian A. Floyd, Kent, Wash.

[73] Assignee: The United States of America as represented by the Secretary of the Air Force, Washington, D.C.

[21] Appl. No.: 202,656

[22] Filed: May 27, 1988

[51] Int. Cl.[4] ..... F41F 3/04

[52] U.S. Cl. ..... 89/1.8; 89/1.916

[58] Field of Search ..... 89/1.8, 1.816; 248/328, 248/610, 636

[56] References Cited

U.S. PATENT DOCUMENTS

| | | | |
|---|---|---|---|
| 3,160,060 | 12/1964 | Zsoka et al. | 89/1.816 |
| 3,368,452 | 2/1968 | Fredrickson et al. | 89/1.816 |
| 3,392,629 | 7/1968 | Soderberg | 89/1.816 |
| 3,421,363 | 1/1969 | Herr | 89/1.8 |
| 3,516,628 | 6/1970 | Kendall | 89/1.8 |
| 3,731,898 | 5/1973 | Smith | 89/1.8 |
| 3,808,942 | 5/1974 | Bhutani et al. | 89/1.816 |
| 3,823,903 | 7/1974 | Kendall et al. | 89/1.8 |
| 3,924,511 | 12/1975 | Kendall et al. | 89/1.8 |
| 4,665,792 | 5/1987 | Gassler et al. | 89/1.816 |

*Primary Examiner*—David H. Brown

*Attorney, Agent, or Firm*—Robert L. Nathans; Donald J. Singer

[57] ABSTRACT

Missile support cables are passed through cable fitter support blocks, which are ridgidly affixed to the silo, and are swaged to heavy blocks resting upon the support blocks via a canister having ductile mesh therein. Upon a downblast, the cables are maintained in tension due to the low downward acceleration of the heavy blocks, while the support blocks are rapidly downwardly accelerated and upon rebound, smash into the energy absorbing canister which prevents the failure of the cables by controlling excess tension therein.

20 Claims, 2 Drawing Sheets

FLOATING FITTING CABLE ATTACHMENT

STATEMENT OF GOVERNMENT INTEREST

The invention described herein may be manufactured, used or licensed by or for the Government of the United States of American for governmental purposes without payment of any royalty therefor.

BACKGROUND OF THE INVENTION

The present invention relates to the field of missile support systems and more particularly to such support systems which are protected against nuclear blast. Nuclear missiles are suspended within cylindrical silos by means of typically six to twelve sets of cables which are affixed to the silo walls. During nuclear attack, these hardened silos are driven downwardly at very high accelerations due to the blast, causing the cables supporting the missiles along with their support equipment to slacken, placing the cables into compression to in turn cause a severe kinking and "bird caging" of the cables to severely weaken them due to the separation of the strands making up the cable. When the silo rebounds upwardly after the blast, pressure over the silo subsides and the already weakened cables readily snap due to the tension induced in the cables owing to extremely high upward accelerations of the walls of the silos.

Early attempts to resolve these problems utilized cable attachments placed on tracks. These designs proved bulky and did not appear to be any more survivable due to uncertainties in the integrity of the tracks during the blast intervals. Additionally, such designs could not readily accommodate a reliable cable severing system which is often needed to permit egress of the missile after blast. At a later time, a cable loop system was designed which resolved most of these problems; however, the loop system resulted .in doubling of the number of recesses in the silo wall and greatly complicated the overall cable system. Synthetic fiber ropes were proposed. Such ropes appeared to be able to survive a nuclear blast but their flexibility posed a design risk in that they could tangle preventing a successful missile egress.

SUMMARY OF THE INVENTION

It is thus a principal object of the invention to prevent the aforesaid bird caging and kinking of the cables supporting the missile during downward acceleration upon the occurrence of a nuclear blast and to prevent the snapping of the thus weakened cables during upward acceleration of the silo upon rebound. It is also an object of the invention to provide a simple and reliable means of severing the support cables when required. Typically, a plurality of missile cable support units are affixed to the inside portions of the silo wall all around the wall in a ring formation as is illustrated in numerous patents; see for example U.S. Pat. No. 3,368,452lines 46–50 of column 4. In accordance with a preferred embodiment of the invention, each unit includes a pair of missile support cables, swaged to cable fitting blocks supported by cable support and guide members firmly bolted to the silo wall. During downward silo wall acceleration due to the blast the cable support members rapidly slide down the cable, and upon upward silo rebound, they smash into an energy absorbing canister affixed to the lower portion of the cable fitting blocks, which action causes the absorbtion of sufficient kinetic energy associated with the upward motion of the support members to prevent snapping of the cable. Also, during initial downward motion of the support members, the aforesaid detrimental buckling of the cables is prevented by the mass of the cable fitting blocks which maintain the cable in tension. A simple reliable cable cutter is positioned within the cable guide member.

BRIEF DESCRIPTION OF THE DRAWINGS

Other objects, features and advantages of invention will become apparent upon study of the following detailed description taken in conjunction with the drawings in which:

As indicated in FIG. 1, a pair of missile support cables 1 and 1 prime have a first terminal portion thereof affixed to a missile support structure (not shown). Typically six or twelve of these units are affixed to the silo wall about the circumference of the inside wall portion. As shown in FIG. 2, cable 1 passes through cable guide 2, shock absorber 3 and swage block 4. The cable guide 2 is incorporated within a cable fitter support device which is rigidly affixed via bolts 13 to silo wall 11. Energy absorbtion member or shock absorber 3 has its upper portion affixed at 5 to the lower portion of swage block 4. Since the second terminal portion of cable 1 is fitted within swage block 4 at portion 6, swage block 4 may also be characterized as a cable fitter member. As stated in page 6–20 of Kent's Mechanical Engineers' Handbook, "Where a light, compact, and highly efficient connection is desired, a swaged or compressed fitting may be utilized. When properly designed and attached, such fitting develops the full strength of the cord or rope . . ."Thus, a portion of the weight of the missile is supported by the silo wall via the cable fitter support means or cable guide 2, the shock absorber or energy absorbing member 3 and swage block 4. In contrast with cable guide 2, shock absorber 3 and swage block 4 are not affixed to the silo wall but are supported by cable guide 2. Recess 9 within silo wall 11 comprises an elongated channel which is formed within the silo wall and extends a considerable distance parallel to the longitudinal missile axis and within wall 11.

Figure 1:
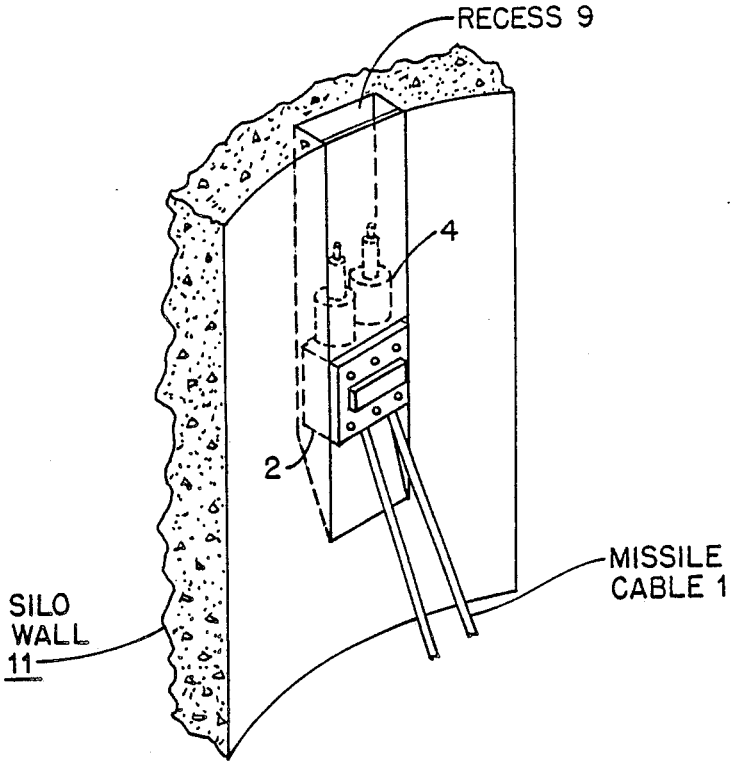
FIGS. 1 and 2 illustrate the key components of the preferred embodiment of the invention.
Figure 2:
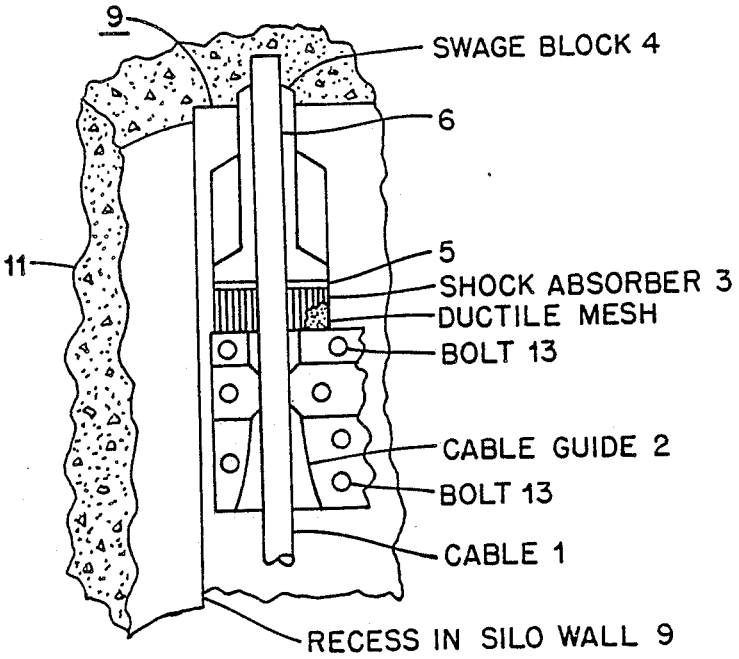

Upon the occurrence of a nuclear blast over the silo, silo wall 11 and cable fitter support member or guide 2 bolted to the wall is driven downwardly several feet in less than one second. Since cable 1 is not affixed to cable guide 2 or to the inner orifice of shock absorber 3, guide 2 will slide down cable 1 and upon the secession of the downward motion, the guide will rebound and smash into energy absorbing member 3 which preferably contains a highly ductile metallic mesh which is crushed by the upward velocity of cable guide 2. This action absorbs sufficient kinetic energy to prevent the cable from otherwise being snapped owing to excessive tension therein. The cable is maintained in tension during the initial downward motion of cable guide 2 because swage block 4 only commenced to fall under the action of gravity. In contrast, the downward acceleration of cable guide 2 is in the hundreds or thousands of g's. For 3-inch diameter cables, the swage block 4 has a weight of at least 100 pounds, and a preferred weight of between 150 and 400 lbs depending on cable size. The thickness of energy absorbing member 3 is not a function of hardness and soil geology; a thickness of about eight inches is deemed satisfactory for silos hardened between 30 and 60 KSI.

Figure 3:
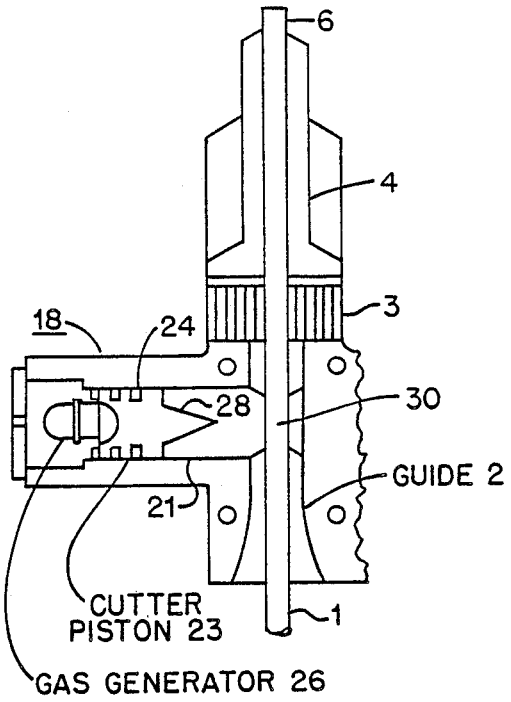
FIG. 3 illustrates a cable severing device.

To allow missile egress from the silo in certain designs it is desirable to sever the missile support cables. As shown in FIG. 3, a cable severing device 18 is provided having a cutter piston 23 slideably positioned within a cylindrical piston chamber. Piston 23 could utilize rings 24 and has a sharp chisel point at 28. A gas generator 26 is ignited by conventional means not shown to produce a blast of gas which propels cutter piston 23 to the right with extremely high acceleration to cause chisel edge 28 to cut cable 1 at portion 30. Where a cable cutter is desired, this design is simple, rugged and thus is highly reliable. The severe accelerations of the silo wall upon occurrence of nuclear blast should not incapacitate the components of cable cutting device 18.

The invention is not to be limited to the particular details described above as obvious modifications may be made by those skilled in the art. Thus the scope of the invention is to be defined only by the language of the following claims and equivalents thereof.

What is claimed is:

1. A missile support unit coupled to a missile silo, for supporting a missile comprising:

(a) cable means having a terminal portion coupled to cable fitter means which is decoupled from said silo and includes a block affixed to the terminal portion of said cable means, said block having sufficient mass to maintain said cable means in tension by virtue of the mass of said block upon the rapid downward acceleration of said silo, thereby to prevent kinking of said cable means;

(b) cable fitter support means rigidly coupled to said silo for supporting said block; and (c) energy absorbing means positioned between said cable fitter means and said cable fitter support means for absorbing sufficient kinetic energy of said cable fitter support means to prevent snapping of said cable means upon upward silo rebound following downward silo acceleration accompanying a blast.

2. The apparatus of claim 1 wherein said cable fitter support means has a cable guide channel therein for enabling relative motion between said cable means and said cable fitter support means upon motion of said silo.

3. The apparatus of claim 1 wherein said cable fitter support means has a cable cutter piston therein actuated by a gas generator.

4. The apparatus of claim 1 wherein said energy absorbing means includes a container having a ductile mesh therein for absorbing said kinetic energy upon the deformation thereof during silo rebound.

5. The apparatus of claim 4 wherein said cable fitter support means has a cable guide channel therein for enabling relative motion between said cable means and said cable fitter support means upon motion of said silo.

6. The apparatus of claim 4 wherein said cable fitter support means has a cable cutter piston therein actuated by a gas generator.

7. The apparatus of claim 1 wherein block has a weight of at least 100 pounds.

8. The apparatus of claim 7 wherein said energy absorbing means includes a container having a ductile mesh therein for absorbing said kinetic energy upon the deformation thereof during silo rebound.

9. The apparatus of claim 7 wherein said cable fitter support means has a cable guide channel therein for enabling relative motion between said cable means and said cable fitter support means upon motion of said silo.

10. The apparatus of claim 7 wherein said cable fitter support means has a cable cutter piston therein actuated by a gas generator.

11. The apparatus of claim 7 wherein said block is swaged to said cable means.

12. The apparatus of claim 11 wherein said energy absorbing means includes a container having a ductile mesh therein for absorbing said kinetic energy upon the deformation thereof during silo rebound.

13. The apparatus of claim 11 wherein said cable fitter support means has a cable cutter piston therein actuated by a gas generator.

14. The apparatus of claim 7 wherein said block has a weight of between 150 and 400 pounds.

15. The apparatus of claim 14 wherein said energy absorbing means includes a container having a ductile mesh therein for absorbing said kinetic energy upon the deformation thereof during silo rebound.

16. The apparatus of claim 14 wherein said cable fitter support means has a cable guide channel therein for enabling relative motion between said cable means and said cable fitter support means upon motion of said silo.

17. The apparatus of claim 14 wherein said block is swaged to said cable means.

18. The apparatus of claim 11 wherein said cable fitter support means has a cable guide channel therein for enabling relative motion between said cable means and said cable fitter support means upon motion of said silo.

19. The apparatus of claim 17 wherein said energy absorbing means includes a container having a ductile mesh therein for absorbing said kinetic energy upon the deformation thereof during silo rebound.

20. The apparatus of claim 19 wherein said cable fitter support means has a cable cutter piston therein actuated by a gas generator.

* * * * *